US006379260B1

(12) United States Patent
Iwade et al.

(10) Patent No.: US 6,379,260 B1
(45) Date of Patent: Apr. 30, 2002

(54) IRON CLUB SET

(75) Inventors: Hirotada Iwade; Shu Katayama, both of Saitama (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 36 days.

(21) Appl. No.: 09/610,443

(22) Filed: Jul. 3, 2000

(30) Foreign Application Priority Data

Jul. 2, 1999 (JP) ..... 11-188836

(51) Int. Cl.[7] ..... A63B 53/04; A63B 53/00

(52) U.S. Cl. ..... 473/290; 473/291; 473/287; 473/246; 473/248

(58) Field of Search ..... 473/287, 290, 473/246, 248, FOR 273, 77 A, 291

(56) References Cited

U.S. PATENT DOCUMENTS 1,642,462 A * 9/1927 Reach
4,971,321 A * 11/1990 Davis
5,388,826 A * 2/1995 Sherwood
5,823,887 A * 10/1998 Mikame et al.
6,071,198 A * 6/2000 Nishizawa et al.
6,093,112 A * 7/2000 Peters et al.

* cited by examiner

*Primary Examiner*—Paul T. Sewell
*Assistant Examiner*—Nini F. Legesse
(74) *Attorney, Agent, or Firm*—Sughrue Mion, PLLC

(57) ABSTRACT

In an iron club set, the lie angle of each iron club in an iron club set is selected to be 61 degrees or larger. The lie angles of the iron clubs are set at a fixed value for every type of the iron clubs including a short iron to a long iron or progressively increase in angle value from the short iron to the long iron. Further, a ratio (L/H) of the minimum height (L) of the face at the heel to the maximum height (H) of the face of the club head, progressively increase in value in going to the long irons.

3 Claims, 3 Drawing Sheets

IRON CLUB SET

BACKGROUND OF THE INVENTION

1. Field of the Invention

The present invention relates to the sequentially progressive settings of lie angles and head configurations of the iron clubs in an iron club set.

2. Description of the Related Art

In an iron club set consisting of a plurality of golf clubs including long irons to wedge-shaped clubs, its design has been made such that the lie angle progressively increases in value in going from long irons to short irons. That is, as going to short irons, the lie angles become upright.

Since the club length becomes short as going to short irons, the lie angles are rendered upright, thereby allowing the golf player to easily swing the club and not in an unnatural posture.

Manipulation of the club generally increases in difficulty as going to long irons. In particular when a powerless golf player of ordinary skill swings the golf club, the club frequently lags in swing. As a result, the golf ball is hit in a state that the club face is turned rightward (in the case of the right-handed player) with respect to the target direction. Consequently, the ball as hit is frequently sliced (in the case of the right-handed player, the ball is curved rightward). Recently, to increase a flying distance of the ball, the golf club of the called strong loft type progressively increases its market share. This type of the club is designed such that the shaft length of the club is longer than that of the conventional one by 0.5 to 1.5 inches, and the loft angle of the club is smaller than that of the conventional one by 2 to 3 degrees. This ball-slicing problem still more attracts a marked attention.

SUMMARY OF THE INVENTION

Accordingly, an object of the present invention is to provide an iron club set which lessens the difficulty in manipulating the golf clubs, particularly a chance of giving rise to the ball-slicing, and makes it easy for the golfer to take a stance without any strain in addressing the ball.

To achieve the above object, a first invention provides an iron club set wherein when the club heads of those clubs being such that the soles of them are placed on a horizontal surface, the loft angles and the lie angles are the regular ones, and those club heads are put in a normal addressing posture, are viewed from the front of the club head, a lie angle as an angle developed between the ground line and the shaft axis is set at 61 degrees or larger, the lie angles of the iron clubs including short irons to long irons are set at a fixed value, and a ratio (L/H) of the minimum height (L) of the face at the heel to the maximum height (H) of the face of the club head increases in value in going from short irons to long irons.

Alternatively, in a second invention, the lie angles increase in value in going from short irons to long irons.

One of the major causes to give rise to the slicing of the ball hit by the long iron is that when the ball is hit with the golf club, the head face is not perpendicular to an intended ball flying direction (target direction), but is directed rightward (in the case of the right-handed golfer). In other words, the major cause is that when the head impacts on the ball, the direction perpendicular to the club head is not parallel to the target direction.

It is known that when the lie angle of the club head is increased, the face is directed leftward. Therefore, in the invention, a large lie angle (61 degrees or greater) of the short iron which is determined so as no impair the easy manipulation of the short iron is employed for all the iron clubs in the set. By so selected, the lie angles of the long irons are larger than that of the conventional ones. As a result, when the golf player of ordinary skill hits the ball, the head face is corrected to be directed perpendicular to the target direction, thereby eliminating the slicing of the ball. Further, in the short irons, their lie angles are left large in value. The easy-to-swing feature is sustained even though the club length is short.

Also, in the second invention, for the like reason, the lie angles increase in value in going from short irons to long irons.

In this case, any of the lie angles (61 to 64 degrees) which have empirically been selected so as not to impair the easy-to-swing of the iron club, is preferably used for the lie angle of the short iron.

In the invention, the lie angle is limited to a value of 61 degrees or greater. In selecting the lie angles of the iron clubs in the set, it is preferable that the lie angle of each of the long irons is within 65 degrees. The reason for this is that if the lie angle of the long iron exceeds 65 degrees, when the player addresses the ball, the toe end extremely rises, so that it is difficult to hit the ball at the center of the head face.

In the invention, the lie angles of the middle irons and long irons are selected to be larger than of the conventional ones. Therefore, when the club head is put for addressing, the toe side considerably rises, and the player will possibly have an unnatural feeling. To cope with this, in the invention, a ratio (L/H) of the minimum height (L) of the face at the heel to the maximum height (H) of the face of the club head increases in value in going from short irons to long irons.

Usually, the upper end (top line) of the club head is configured such that it monotonously inclines from the maximum height portion of the face toward the heel In connection with this, in the invention, the ratio (L/H) is defined as mentioned above. By so defined, in the long irons within the set, the top lines of them are gentle in slant and substantially flat. As a result, the unnatural feeling caused by the extreme rise of the toe end at the time of ball-addressing is successfully eliminated.

In the invention, long irons include Nos. 1 to 3, middle irons includes Nos. 4 to 6 irons, and short irons include Nos. 7 to 9 irons.

DETAILED DESCRIPTION OF THE PREFERRED EMBODIMENTS

The preferred embodiments of the present invention will be described in accordance with the accompanying drawings.

Figure 1A:
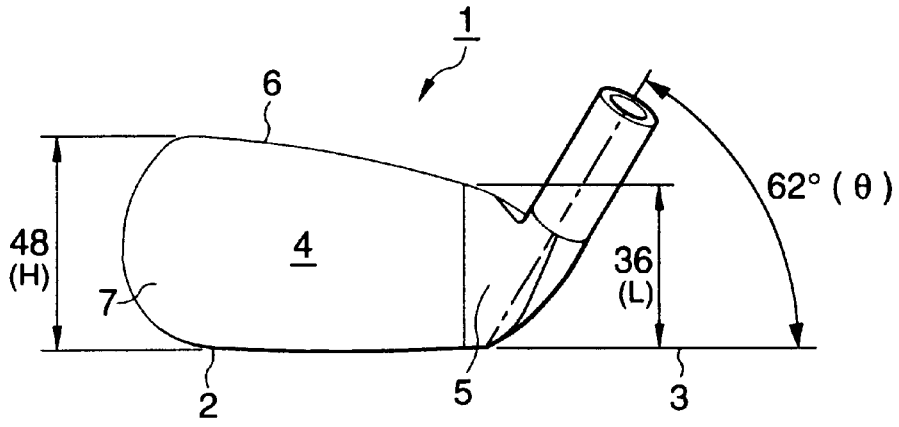
FIGS. 1A to 1C are front views showing the club heads of the Nos. 3, 6 and 9 iron clubs according to an embodiment 1 of the present invention.
Figure 1B:
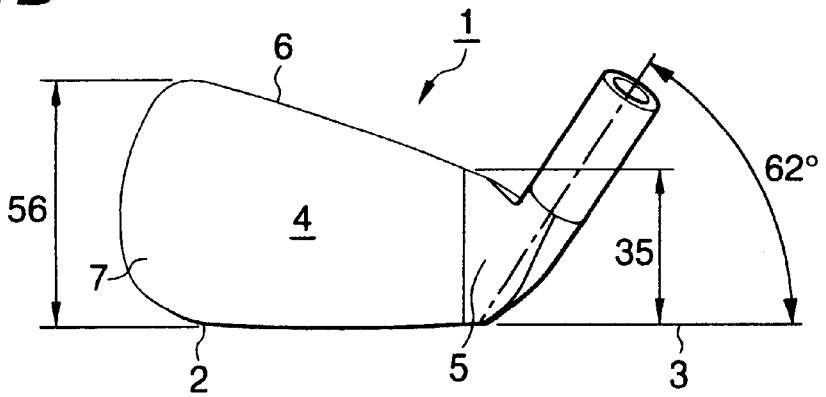
Figure 1C:
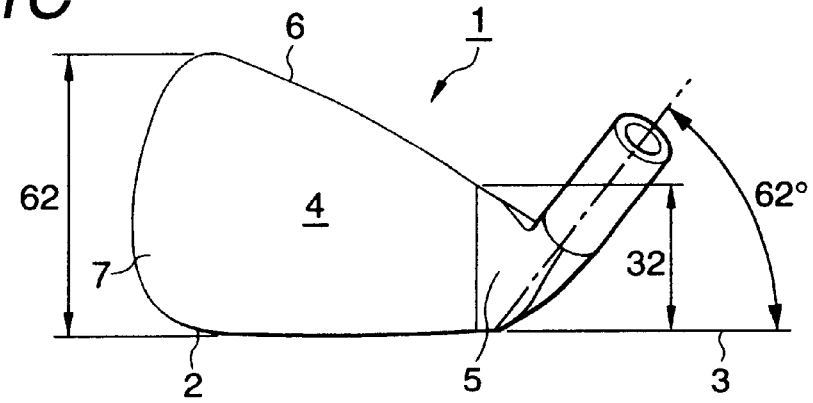

FIGS. 1A to 1C are front views showing the club heads of Nos. 3, 6 and 9 iron clubs selected from an iron club set including iron clubs Nos. 2 to 9, eight in total, and pitching and sand wedge clubs, which are constructed as an embodiment 1 of the present invention, those club heads 1 being such that the soles 2 of them are placed on a horizontal ground surface (ground line) 3, the loft angles and the lie angles are the regular ones, and those club heads are put in a normal addressing posture.

In the embodiment 1, the lie angle is selected to be 62 degrees for all the Nos. 2 to 9 irons in the iron club set.

FIG. 1A shows the No. 3 iron club as a long iron club. 62 degrees of the lie angle as set is larger than the lie angle (57 to 60.5 degrees) of the conventional No. 3 iron. When the player swings the iron club, a face 4 is closed (in the case of the right-hander, the face is directed leftward) to the target direction (target direction of the hit ball), thereby correcting the slicing tendency.

The maximum height (H) of the face 4 is 48 mm, and the minimum height (L) of the face at the heel 5 is 36 mm, and a ratio (L/H) of them is 75%. The ratio is about 10% larger than of the conventional ones as described in the comparison to be described later. As a result, a slant of the top line 6 of the face 4 is removed to be flat, and hence, at the time of ball-addressing, the player does not perceive the toe end being raised and is free from the unnatural feeling.

FIG. 1B shows the No. 6 iron as the middle iron. 62 degrees of the lie angle as set is somewhat larger than (59 to 61.5 degrees) of the conventional one. Accordingly, there is less chance that the balls are given slicing rotation for those powerless golf players. Further, the unnatural feeling caused at the time of ball-addressing is almost perfectly removed since the ratio (L/H) of the minimum height (L) of the face 4 at the heel 5 to the maximum height (H) of the face 4 of the club head is relatively high.

FIG. 1C shows a front view of the No. 9 iron as the short iron. 62 degrees of the lie angle as set is within a range of lie angles empirically selected as angles to allow the player to swing the clubs of short length without taking an unnatural posture. Therefore, the easy-to-swing feature is retained as in the convention case.

The ratio (L/H) of the minimum height (L) of the face 4 at the heel 5 to the maximum height (H) of the face 4 of the head club is 51.6%, viz., about 10% smaller than an average value (60% to 63%) of the conventional one, in order -that the player perceives that an extent of the rise of the toe end occurring at the time of ball-addressing, viz., a degree of a slant of the top line of the face 4, is substantially equal to those of the long and middle irons, and that a feel of ball-addressing is uniform among those iron clubs in the set.

Next, an embodiment 2 of the invention will be described.

Figure 2A:
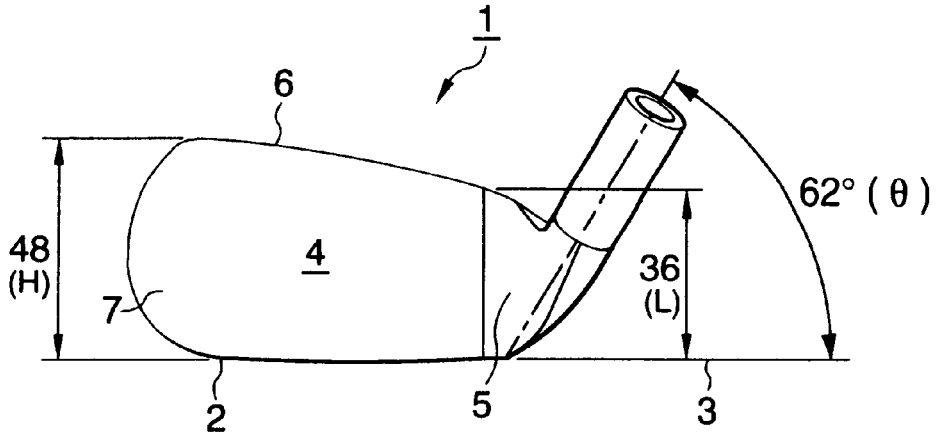
FIGS. 2A to 2C are front views showing the club heads of the Nos. 3, 6 and 9 iron clubs according to an embodiment 2 of the present invention.
Figure 2B:
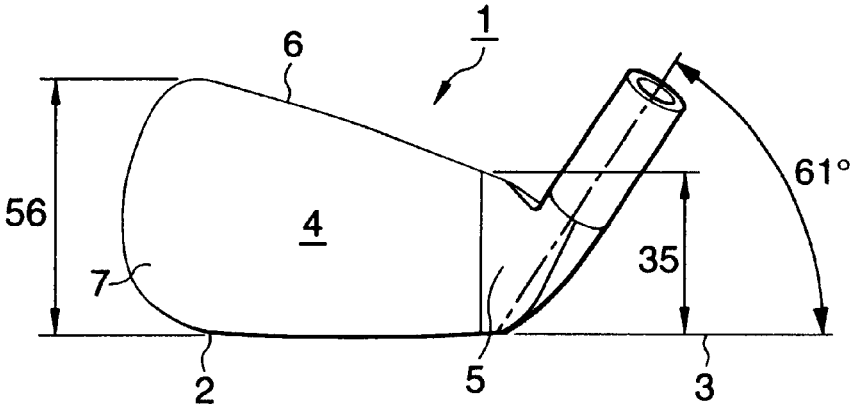
Figure 2C:
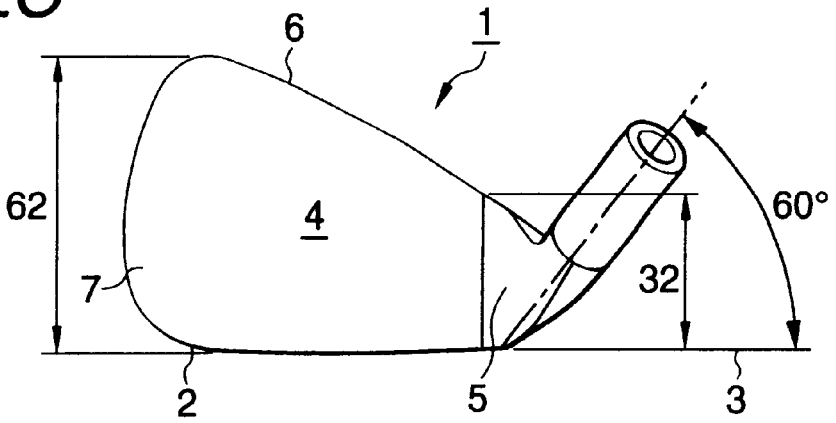

FIGS. 2A to 2C are front views showing the Nos. 3, 6 and 9 irons selected, as typical examples of the long, middle and short irons, from those iron clubs in the iron club set of the embodiment 2.

In the embodiment, the lie angle (θ) increases in value in going from the short irons to the long irons.

The ratio (L/H) of the minimum height (L) of the face 4 at the heel 5 to the maximum height (H) of the face 4 of the club head is selected to be equal to that in the embodiment 1 for each club number. Accordingly, this embodiment can also have useful effects comparable with those of the embodiment 1.

Figure 3A:
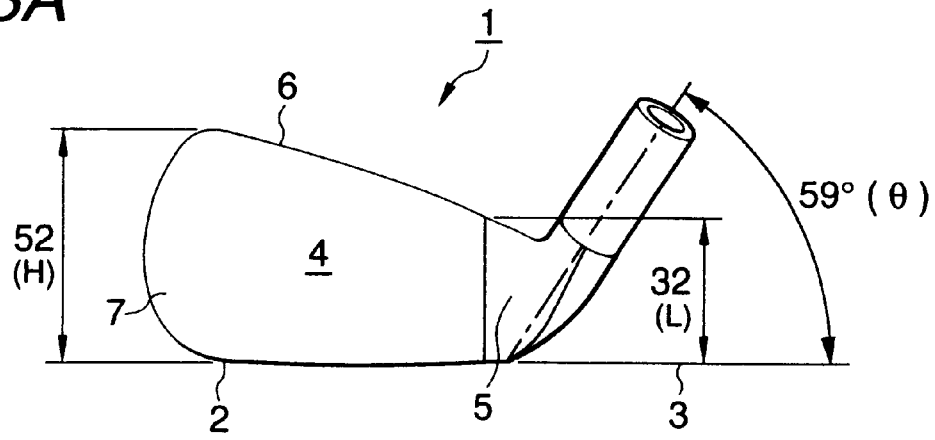
FIGS. 3A to 3C are front views showing the club heads of the comparative conventional Nos. 3, 6 and 9 iron clubs.
Figure 3B:
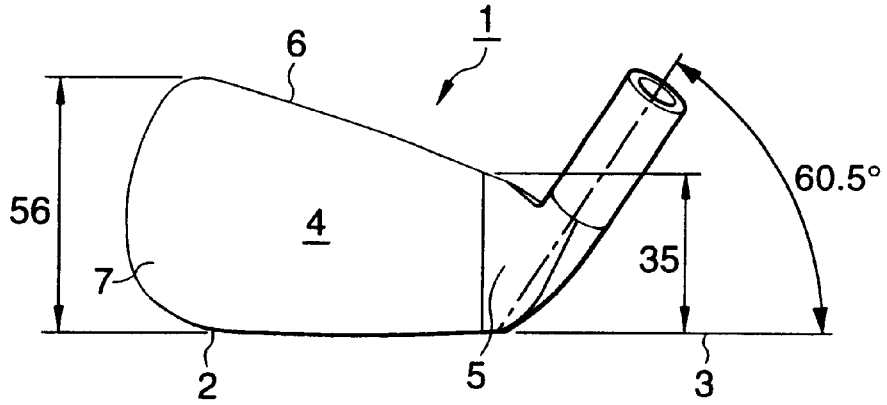
Figure 3C:
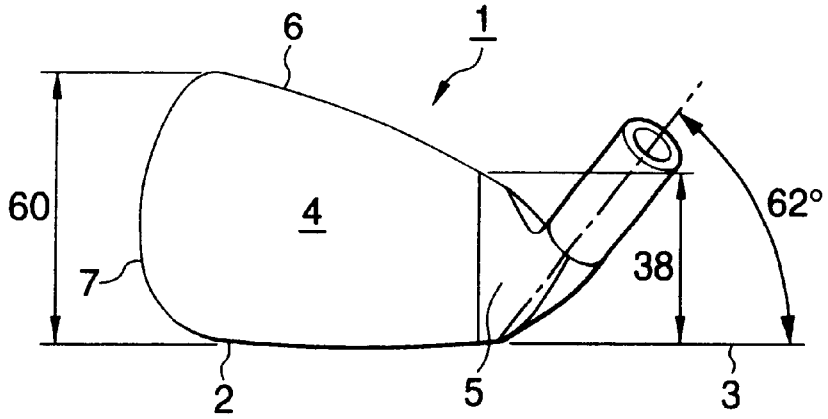

For ease of comparison of the above-mentioned embodiments of the invention with the conventional products, conventional products (commercially available products and their trade names by the applicant of the present patent application) are typically shown in FIGS. 3A to 3C. In those comparison iron clubs, the lie angle (θ) of the No. 9 iron as a short iron is 62 degrees, the lie angle of the No. 6 iron as a middle iron is 60.5 degrees, and the lie angle of the No. 3 iron as a long iron is 59 degrees. Thus, the lie angle progressively decreases in value from the short irons to the long irons. The order of the lie angles of the iron clubs in the set is reverse to that of the lie angles of the iron clubs in the embodiment. Particularly, the lie angle order of the comparison irons is fairly reverse to that in the case of the invention.

The ratio (L/H) of the minimum height (L) of the face 4 at the heel 5 to the maximum height (H) of the face 4 of the club head is 63.3% for the No. 9 iron. The ratio of the No. 6 iron is 62.5%, and the ratio of the No. 3 iron is 61.5%. Thus, the ratios of those irons progressively decrease in value from the short irons to the long irons. The, the order of the ratios of those comparison irons is also reverse to that in the case of the present invention.

In the iron club set according to the present invention, the lie angle is set at a large fixed value for all the iron clubs including the short irons to the long irons or the lie angle progressively increases its value in going from the short irons to the long irons. The ball slicing which has been problem for the powerless, ordinary golf player and is easy to occur in case of the long iron clubs, is remarkably reduced.

In the long iron having an increased lie angle, the ratio (L/H) of the minimum height (L) of the face at the heel to the maximum height (H) of the face of the club head is selected so that the top line of the face is gently slanted. Therefore, the player may swing the club without any unnatural feeling at the time of ball-addressing and free from anxiety.

What is claimed is:

1. An iron club set comprising a plurality of short, middle and long iron clubs each having a club head, wherein when soles of said clubs heads are squarely placed on a horizontal surface in a normal addressing posture, each of said clubs has a lie angle of 61° to 64° wherein the lie angle is defined as an angle between a ground line of the horizontal surface and a shaft axis of each of the iron clubs, and a ratio (L/H) of the minimum height (L) of a face at the heel to the maximum height (H) of said face of each of said club heads increases in value in going from short irons to long irons.

2. An iron club set according to claim 1, wherein said lie angles increase in value in going from short irons to long irons.

3. An iron club set comprising a plurality of short, middle and long iron clubs each having a club head, wherein when soles of said clubs heads are squarely placed on a horizontal surface in a normal addressing posture, each of said clubs has substantially the same lie angle in a range of 61° to 64° through the short, middle and long iron clubs, and a ratio (L/H) of the minimum height (L) of a face at the heel to the maximum height (H) of said face of each of said club heads increases in value in going from short irons to long irons.

* * * * *